US005934203A

United States Patent [19]

Glass

[11] Patent Number: 5,934,203

[45] Date of Patent: Aug. 10, 1999

[54] TABLE CONSTRUCTION

[75] Inventor: Peter Glass, Napa, Calif.

[73] Assignee: Virco Mfg. Corporation, Torrance, Calif.

[21] Appl. No.: 08/932,567

[22] Filed: Sep. 19, 1997

[51] Int. Cl.[6] ..... A47B 47/00

[52] U.S. Cl. ..... 108/156; 248/188.8; 108/50.02

[58] Field of Search ..... 108/50.02, 158, 108/156; 248/188.2, 188.8, 188

[56] References Cited

U.S. PATENT DOCUMENTS

| | | | |
|---|---|---|---|
| 2,852,221 | 9/1958 | Steiner | 248/188 |
| 2,942,923 | 6/1960 | Herrmann | 248/188 |
| 3,063,765 | 11/1962 | Huff | 108/156 |
| 3,143,375 | 8/1964 | Langbaum | 108/156 |
| 3,267,888 | 8/1966 | Carlson | 108/158 |
| 5,277,131 | 1/1994 | Fortsch | 108/50.02 |

*Primary Examiner*—Peter M. Cuomo
*Assistant Examiner*—Gerald A. Anderson
*Attorney, Agent, or Firm*—James E. Brunton

[57] ABSTRACT

A table construction which can be quickly and easily dissembled for highly compact storage and one which is extremely versatile in use and highly attractive in appearance. A key aspect of the table construction is a novel, attractively sculptured leg assembly that can be used to support one or more table tops of varying configuration. The leg assembly is specially designed and configured so that it can be quickly attached to and removed from the table tops for easy storage and transport of both the legs and the tabletops. Because of the novel design of the leg assemblies, which include a broad, generally fan-shaped upper surface, a single leg assembly can be used to effectively support two adjacent table tops of either a conventional rectangular configuration or of non-rectangular design as, for example, tabletops having angularly extending sides. Each leg assembly is uniquely designed to provide rigid stable support of the tabletops and carries with it a compact connecting tool for use in conveniently connecting the leg assembly to the tabletop.

3 Claims, 14 Drawing Sheets

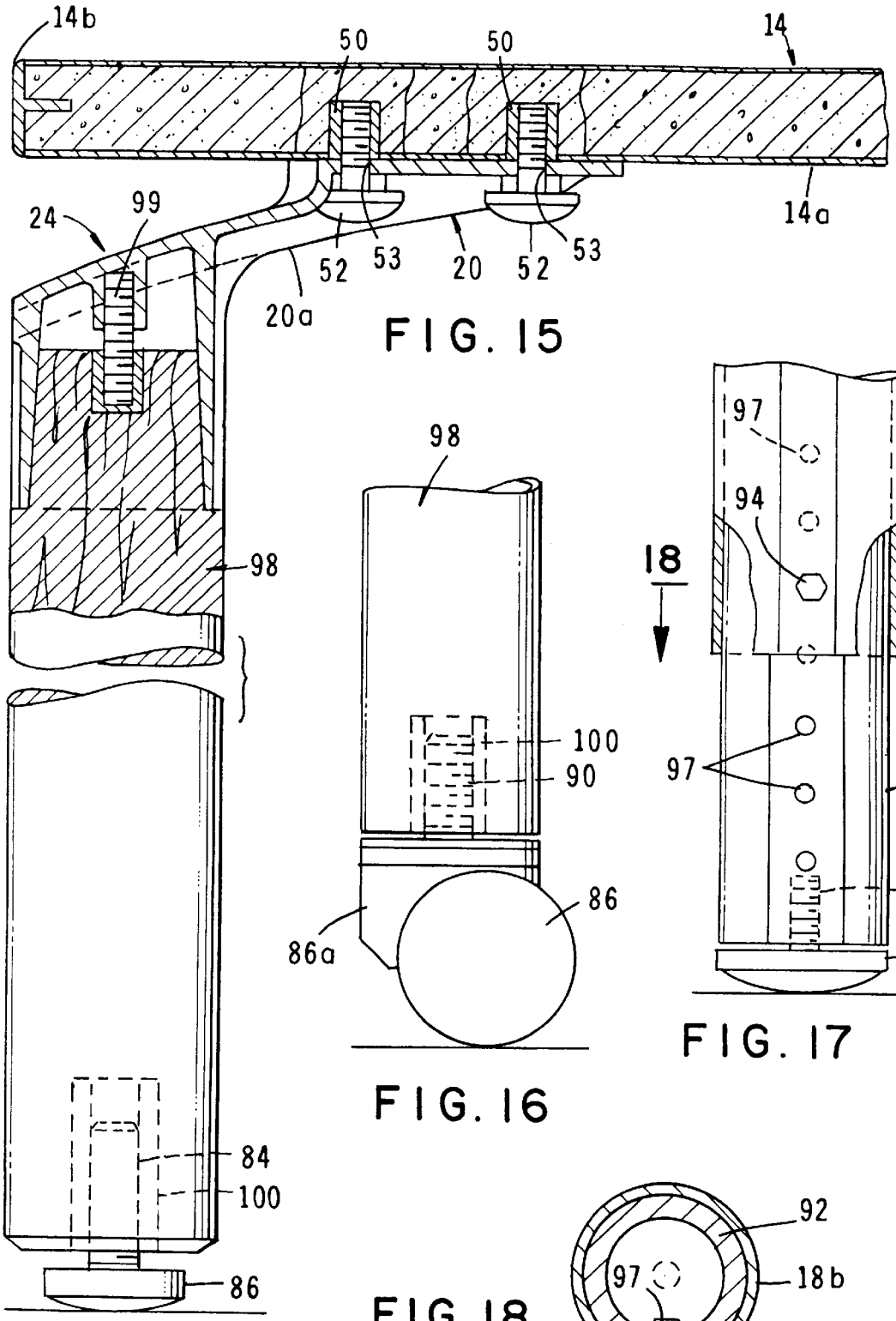
FIG. 15
FIG. 16
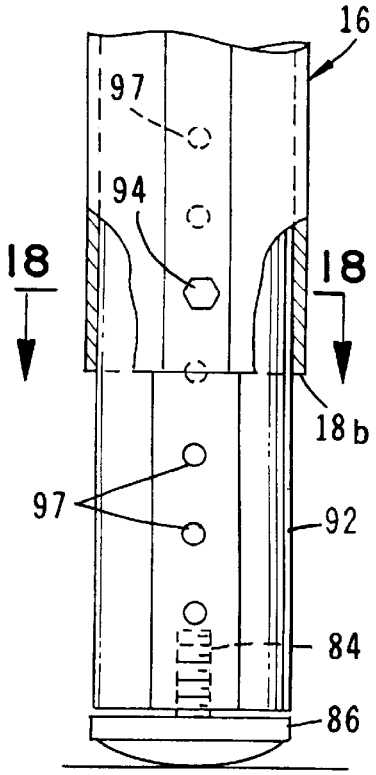
FIG. 17
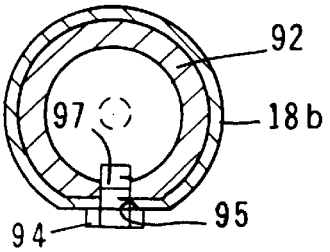
FIG. 18

TABLE CONSTRUCTION

BACKGROUND OF THE INVENTION

1. Field of the Invention

The present invention relates generally to furniture. More particularly, the invention concerns a novel highly attractive and versatile leg assembly for supporting one or more adjacent tabletops.

2. Discussion of the Prior Art

The prior art is replete with table designs which vary from the simplest four legged, rectangular table design to elaborate multi-leaf, adjustable and foldable tables. However, little innovative work has been done in recent years in the design of furniture for institutional use, such as in convention centers, large hotels, and in banquet and conferencing facilities.

A basic requirement for most institutional type furniture is that it can be readily transported and quickly and easily placed into and taken out of service and conveniently stored within relative small storage areas. To meet these requirements, foldable chairs and tables have been heavily relied upon. However, foldable furniture is not without drawbacks. For example, large folding tables are typically quite heavy and folding the tables is often cumbersome and difficult. Additionally, many of the prior art foldable tables are somewhat unstable and are not well suited for supporting heavy equipment such as overhead projectors, video conferencing equipment and the like. Further, the prior art foldable tables often embody folding mechanisms which are difficult to manipulate and often are subject to debilitating damage. Additionally, most of the prior art folding tables are quite unattractive and often have a limited useful life.

For the reasons set forth in the preceding paragraph, there is a real need for a new design of non-foldable, easily storable, durable and yet highly attractive table which is well suited for institutional applications. Such tables should be easily dissembled, light weight, and versatile in use.

SUMMARY OF THE INVENTION

The thrust of the present invention is to provide a viable substitute for large folding tables and one which overcomes most of the drawbacks of such tables. More particularly, a primary object of the present invention is to provide a table construction which can be quickly and easily dissembled for highly compact storage and one which is extremely versatile in use and highly attractive in appearance.

By way of summary, a key aspect of the table construction of the present invention is a novel, attractively sculptured leg assembly that can be used to support one or more table tops of varying configuration. The leg assembly is specially designed and configured so that it can be quickly attached to and removed from the tabletops for easy storage and transport of both the legs and the tabletops.

Because of the novel design of the leg assemblies, which include a broad, generally fan-shaped upper surface, a single leg assembly can be used to effectively support two adjacent table tops of either a conventional rectangular configuration or of non rectangular design as, for example, tabletops having angularly extending sides. Each leg assembly is uniquely designed to provide rigid stable support of the tabletops and carries with it a compact connecting tool for use in conveniently connecting the leg assembly to the tabletop.

In one form of the table construction of the invention, which is particularly well suited for lecturing and video conferencing, the tabletop is provided with a wire receiving aperture through which electrical wires and the like can be fed into a specially configured wire supporting apron and then into securement channels provided in the table legs for hazard free connection of the wires to proximately located power receptacles.

SUMMARY OF THE INVENTION

In summary, the novel table construction of the invention comprises at least one tabletop member having a generally planar first surface, a spaced-apart generally planar second surface, and a peripheral portion circumscribing the first and second surfaces. Connected to the lower surface of the tabletop is at least one leg assembly, which includes a leg member having an upper portion, a lower portion and an intermediate portion. The upper portion of the leg includes a hollow socket which telescopically receives the lower portion of a novel connector means which function to interconnect the leg member with the tabletop member.

In one form of the invention the connector means comprises a first top engaging segment, a second extension segment connected to and extending angularly downward from the top engaging segment and the previously identified lower portion or connecting segment which is connected to and extends downward from the second extension segment. The tabletop engaging segment is of a novel configuration having a broad fan-shaped engagement surface that is disposed within a first plane which is substantially parallel to the plane of the second surface of the tabletop. The second extension uniquely includes a sloping top surface which is disposed within a second plane that extends at an acute angle with respect to the plane of the bottom surface of the tabletop thereby creating a novel and pleasing design feature.

It is an object of the present invention to provide a novel, easily disassembled table construction for institutional use which is highly attractive and extremely versatile in use.

Another object of the invention is to provide a table construction of the aforementioned character which is ideally suited for use in connection with seminars and conferences held in hotels, auditoriums, conferencing centers and the like.

Another object of the invention is to provide a table construction of the aforementioned character in which the attractively sculptured leg assembly of the table can be quickly and easily disconnected from the table top thereof so that the components of the table can be easily transported and stored.

Another object of the invention is to provide a table construction of the character described in which a single leg assembly can be used to support the corners of adjacently disposed tabletops.

Another object of the invention is to provide a table construction which includes a tabletop and an easily removable sculptured leg assembly which includes a tabletop engaging segment having an attractive fan-shaped tabletop engaging surface and a downwardly and outwardly sloped surface from which a leg connecting section depends.

Another object of the invention is to provide a table construction as described in the foregoing paragraphs which is provided with a novel wire management system for use in the orderly routing of conduits from the upper surface of the tabletop, along the edges of the table, downwardly through wire receiving channels provided in the leg assembly and then outwardly to an appropriate source of power or other utility.

Another object of the invention is to provide a table construction in which the leg assembly is connected to the table top using connectors having a threaded shaft and a wrench engaging hole and in which the leg assembly carries within a cavity provided in the upper surface thereof a wrench suitable for installing and removing the connectors.

Still another object of the invention is to provide a table construction of the class described in which the various components can be mass produced in large quantities at relatively low cost.

BRIEF DESCRIPTION OF THE DRAWINGS

FIG. 15 is an enlarged, side-elevational view of one of the leg assemblies of the table construction of the invention partly broken away to shown internal construction.

FIG. 16 is a greatly enlarged, side-elevational view of the bottom portion of one of the legs of the table construction of the invention showing an assembly affixed to the leg assembly of the table construction.

FIG. 17 is a side-elevational view of an alternate form of the leg construction of the table of the invention.

FIG. 18 is a cross-sectional view taken along lines 18—18 of FIG. 17.

DESCRIPTION OF THE INVENTION

Figure 2A:
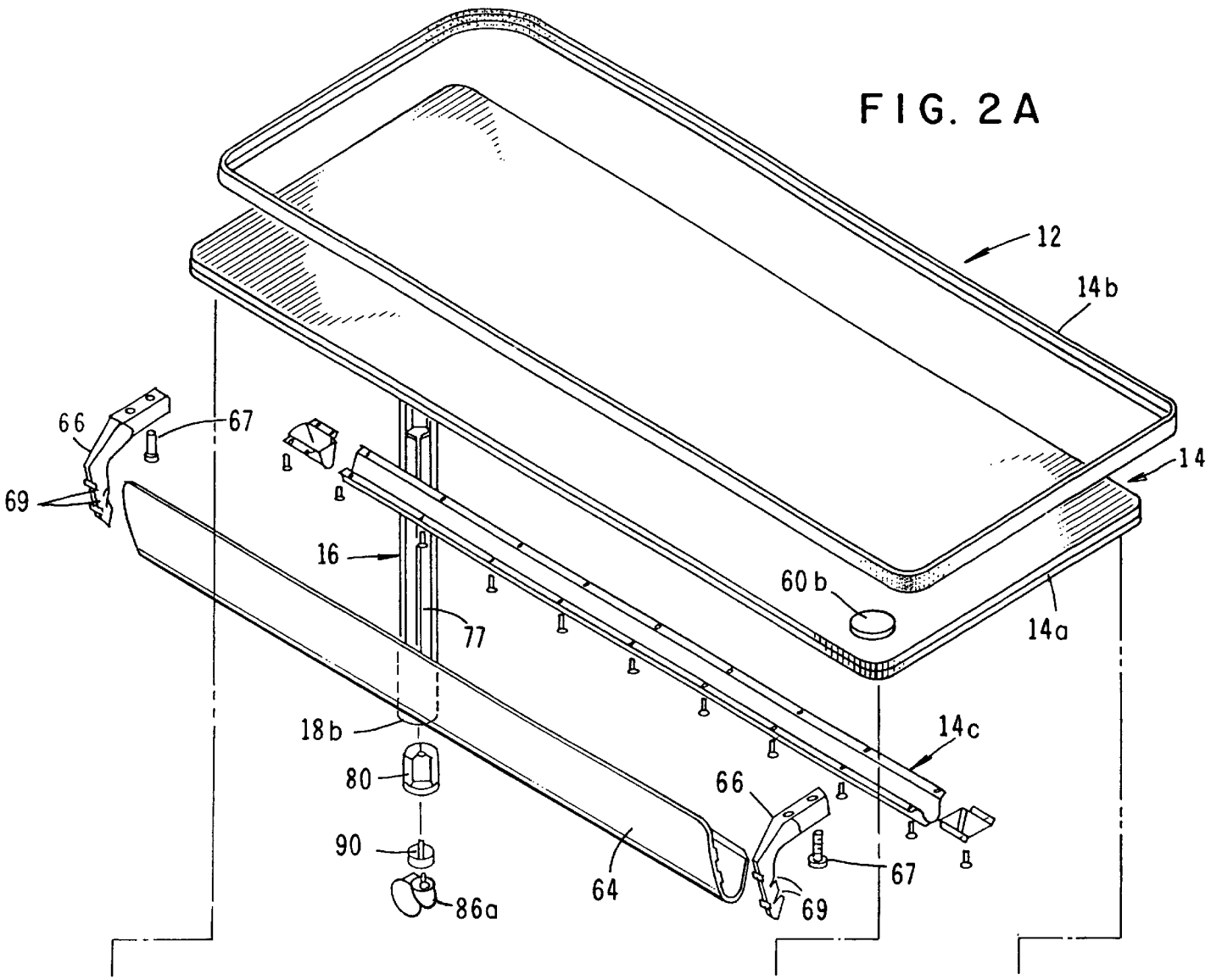
FIGS. 2A and 2B when considered together comprise the generally perspective, exploded view of the table construction shown in FIG. 1.
Figure 2B:
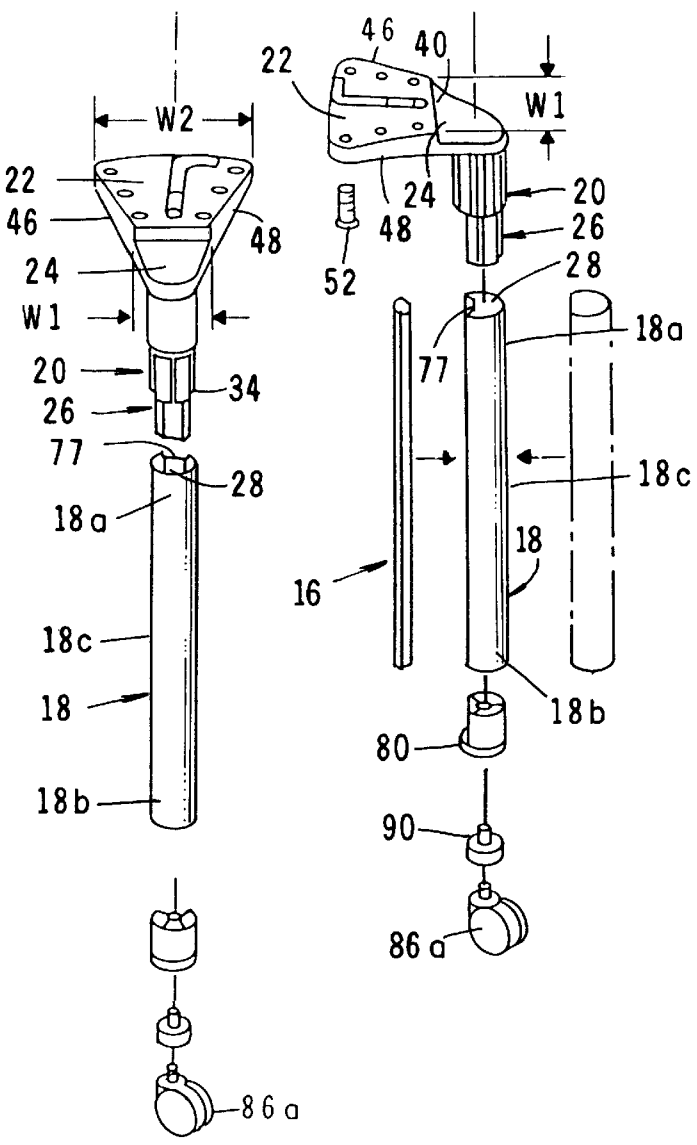
Figure 2B:
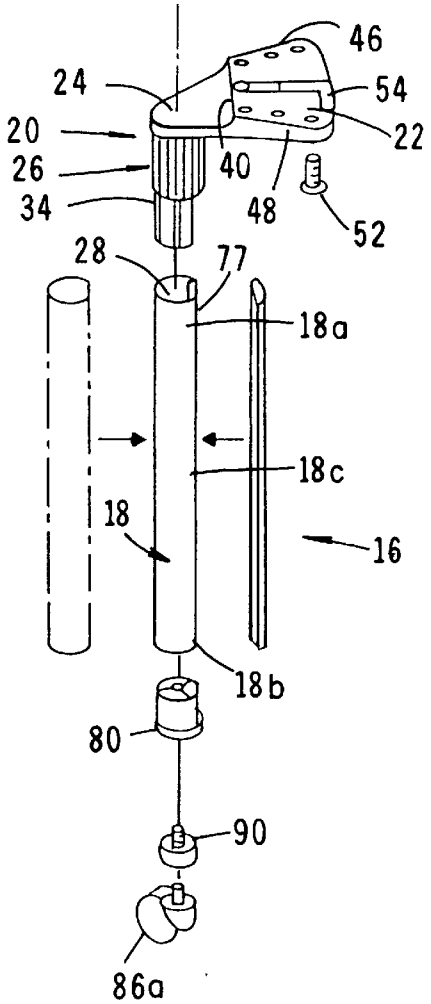
Figure 3:
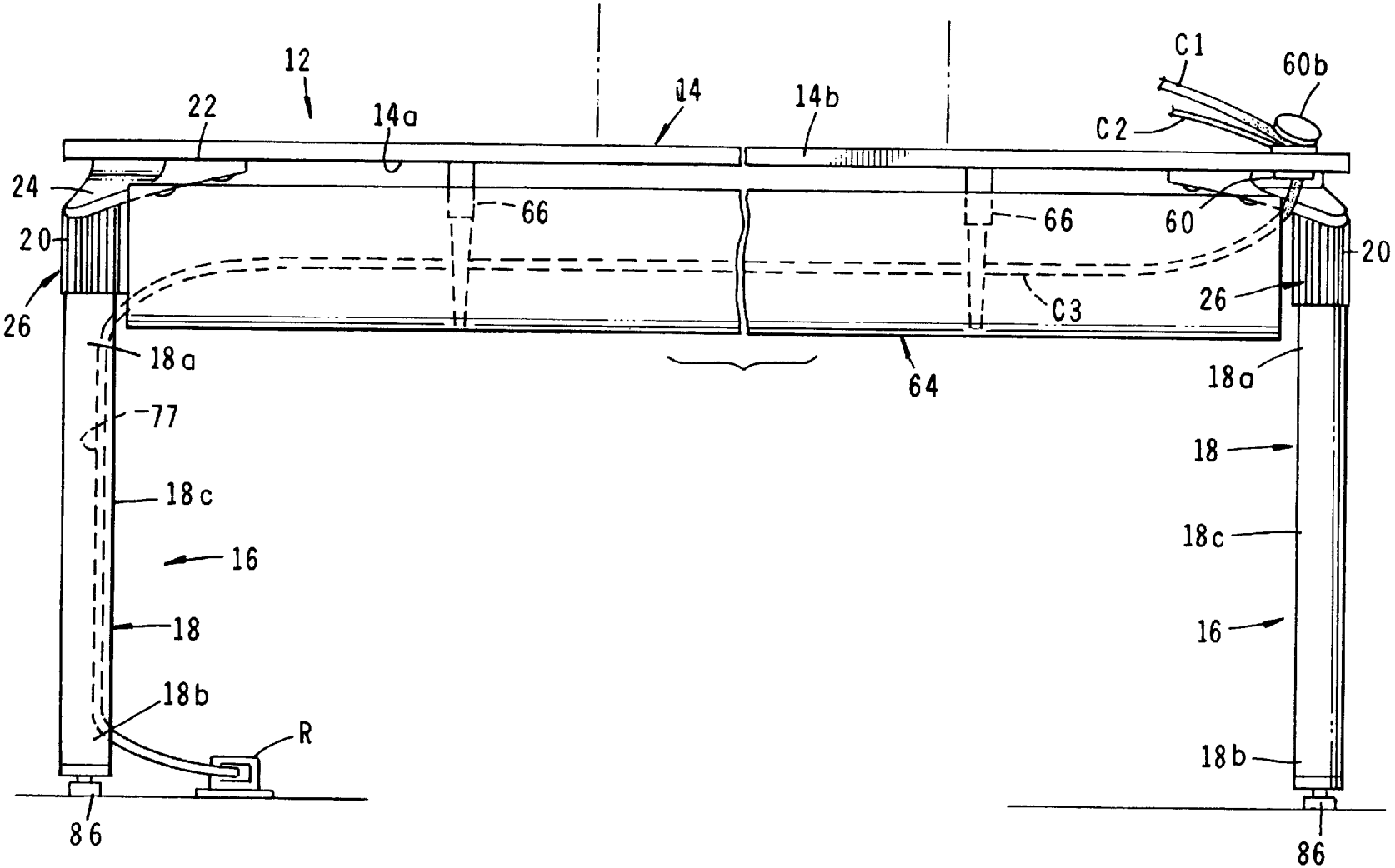
FIG. 3 is a side-elevational view of the table construction shown in FIG. 1.
Figure 4:
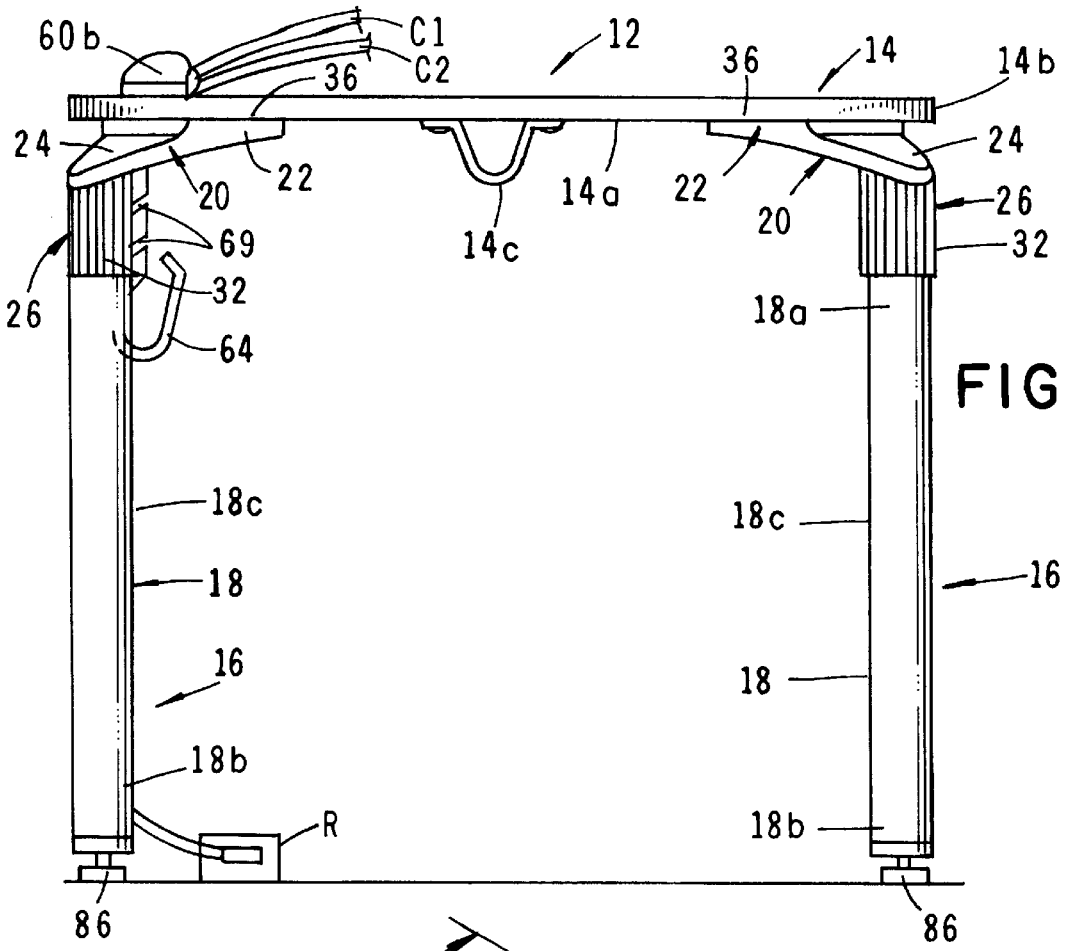
FIG. 4 is an end view of the table construction shown in FIG. 1.

Referring to the drawings and particularly to FIGS. 1 through 5, one form of the table construction of the present invention is there illustrated and generally designated by the numeral 12. The table construction here comprises at least one tabletop or support member 14, and a plurality of identically configured leg assemblies 16 which are connected to the lower surface 14*a* of the tabletop member. Circumscribing member 14 is a decorative trim 14*b*, (FIG. 2A) and extending longitudinally of the undersurface of the tabletop is a central keel member 14*c* (FIGS. 2A and 4). Each leg assembly 16 comprises a leg portion 18 and a novel connector member 20 for interconnecting leg 18 with the tabletop 14 (FIG. 2B).

Figure 5:
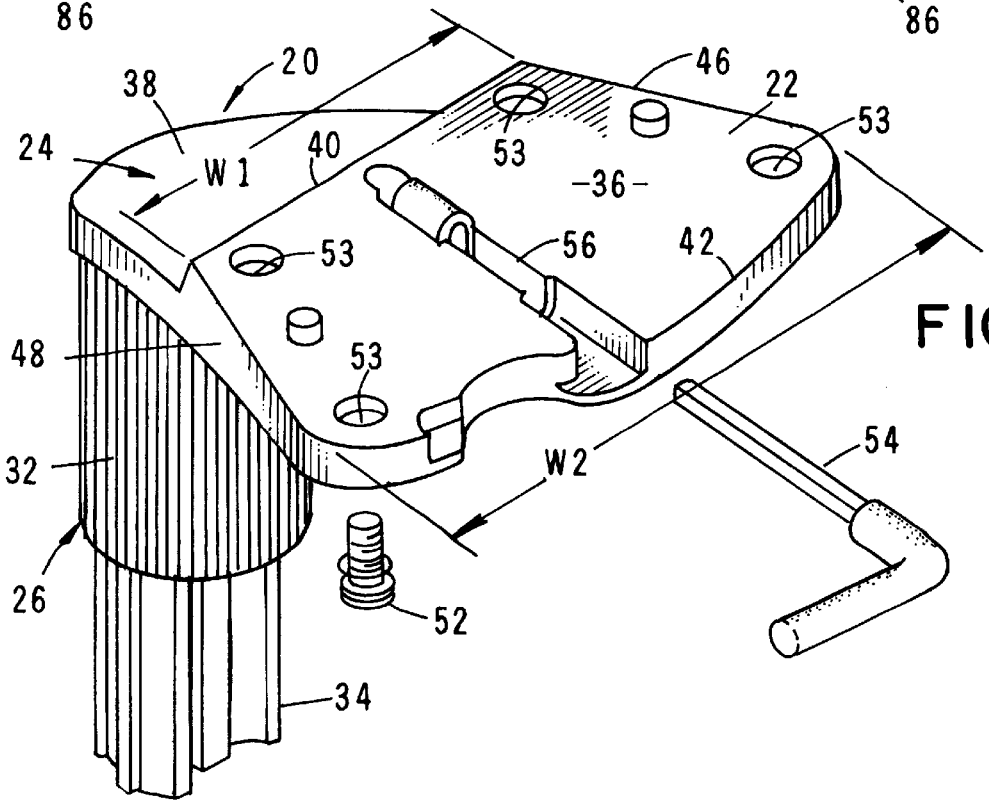
FIG. 5 is a greatly enlarged, generally perspective view of one form of the novel leg connector assembly of the table construction of the invention.
Figure 6:
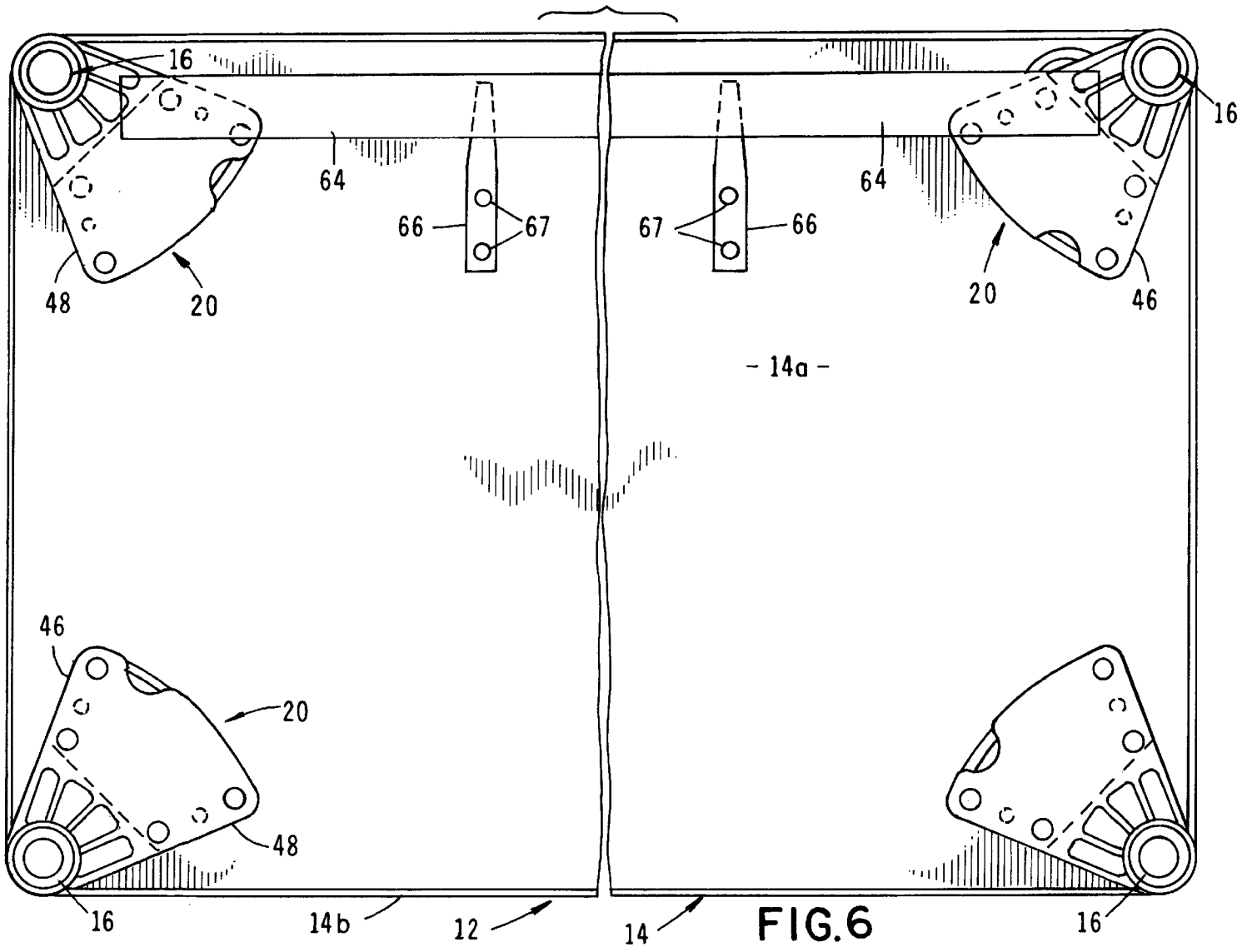
FIG. 6 is a bottom plan view of the table construction shown in FIG. 1.
Figure 7:
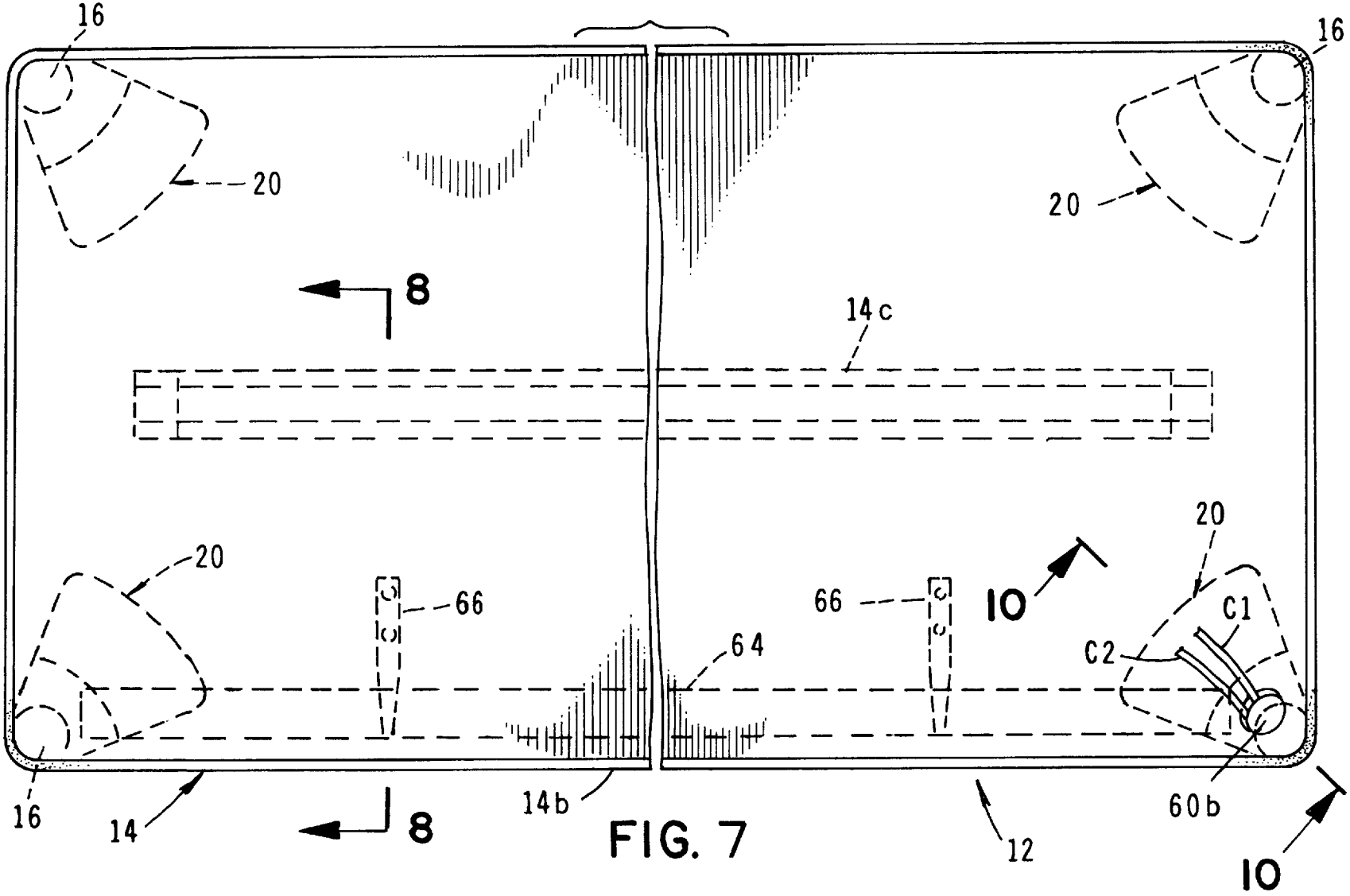
FIG. 7 is a foreshortened, top plan view of the table construction shown in FIG. 1.

As best seen by referring to FIGS. 2B and 5, the connector means or connector 20 of the present form of the invention comprises a first, top engaging segment 22, a downwardly sloping second extension segment 24 and leg engaging segment 26 which is connected to and extends downwardly from second extension segment 24.

Figures 10, 11, 12:
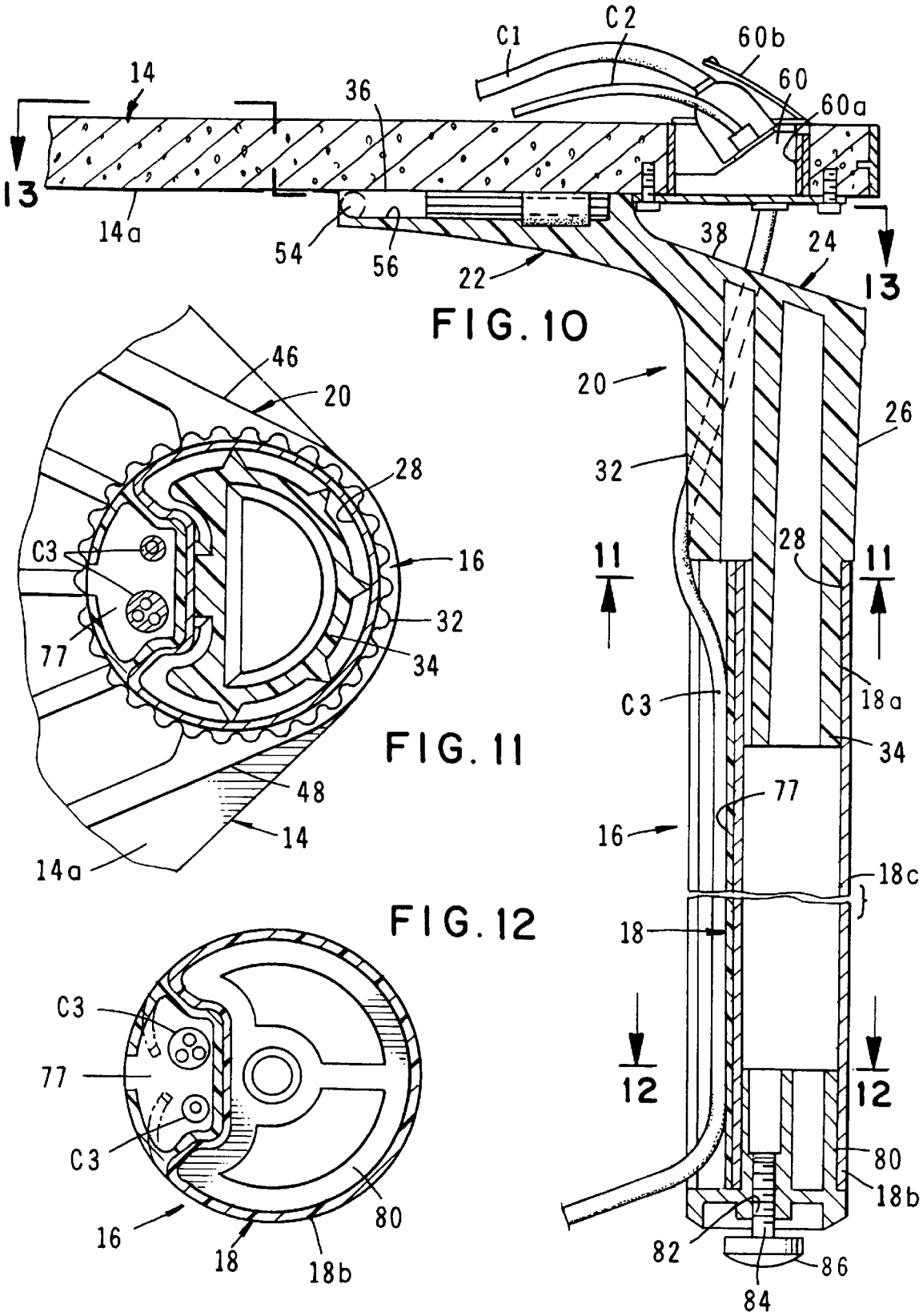
FIG. 10 is a greatly enlarged, cross-sectional view taken along lines 10—10 of FIG. 7.
FIG. 11 is a cross-sectional view taken along lines 11—11 of FIG. 10.
FIG. 12 is a cross-sectional view taken along lines 12—12 of FIG. 10.

Referring particularly to FIGS. 2B, 10, and 11 it is to be noted that leg 18 includes and upper portion 18*a*, a lower portion 18*b* and an intermediate portion 18*c*. Formed in upper portion 18*a* of leg 18 is a socket 28 which is configured to closely, telescopically receive therewithin a portion of the leg assembly engaging segment 26 of the connector means. As indicated in FIGS. 10 and 11, socket 28 extends downwardly into upper portion 18*a* of the leg and is generally horseshoe shaped in cross section (FIG. 11).

Referring once again to FIG. 5, it can be seen that leg assembly engaging segment 26 is made up of a striated portion 32 which is generally cylindrical in shape and a lower portion 34 which, as shown as FIGS. 10 and 11, is closely telescopically received within socket 28 formed in upper portion 18*a* of leg 18.

Referring both to FIGS. 5 and 10, it can be observed that the first top engaging segment 22 of the connector means includes a top engaging surface 36 which is disposed within a first plane that is substantially parallel to the second surface 14*a* of tabletop 14 (FIG. 10). Similarly, second extension segment 24 includes a generally plainer surface 38, which is disposed in a second plane that extends at an acute angle with respect to the first plane and with respect to the plane of the lower surface 14*a* of the tabletop. In the form of the invention shown in the drawings, upper portion 32 of connector segment 26 is striated and functions along with surfaces 36 and 38 to provide a unique sculptured design having extremely pleasing features.

Figure 13:
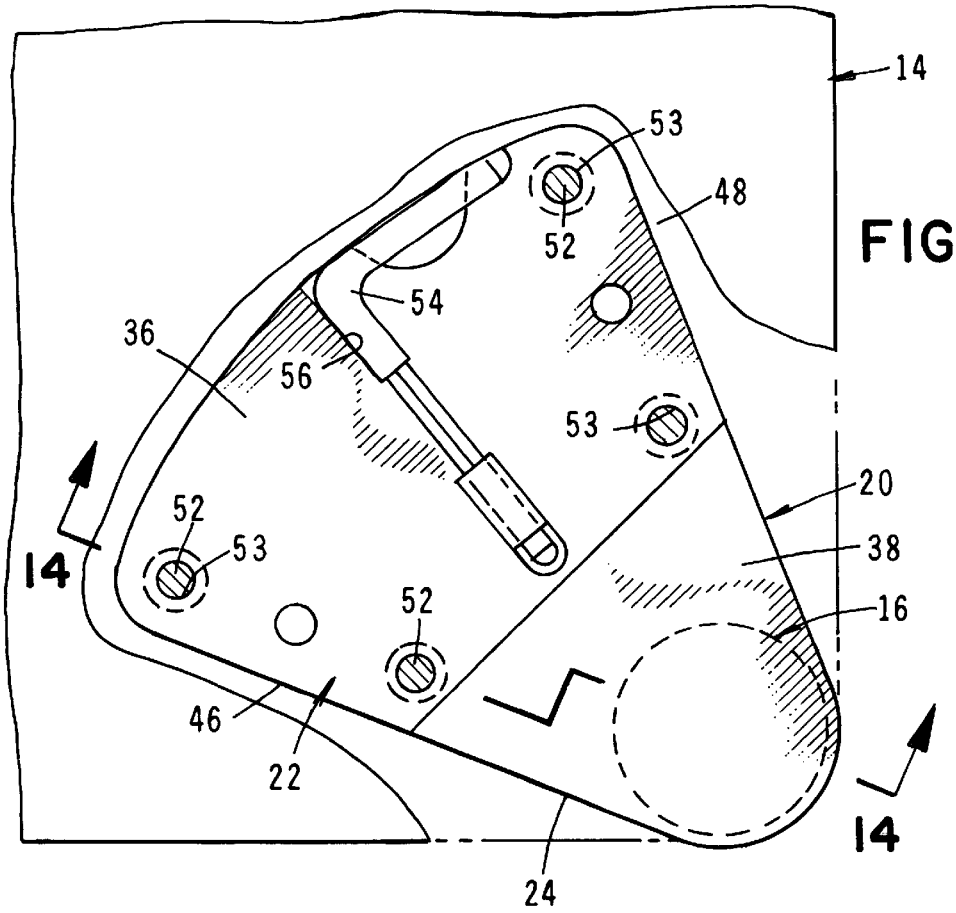
FIG. 13 is a cross-sectional view taken along lines 13—13 of FIG. 10.

Another important feature of the connector means of the invention resides in the broad generally fan shape of the upper surface 36 of segment 22. More particularly, segment 22 has a first end 40 which is of a first width W-1 (FIGS. 2B, and 10) and a second end 42 having a second width W-2 which is less than width W-1. Angularly, inwardly extending sides 46 and 48 interconnect ends 40 and 42 of segment 22 (FIG. 5). Further contributing both to the ornamental appearance and the utility of the connector means is the fact that second segment 24 of the connector means is generally fan shaped in configuration (FIGS. 5 and 13).

In a manner presently to be described, this important configuration of the connector means of the invention permits broad, fan shaped segment 22 to span two adjacent tables either of a rectangular configuration (see, for example, FIG. 20) or the configuration wherein the sides of the tabletop extend angularly with respect to one another.

Figure 14:
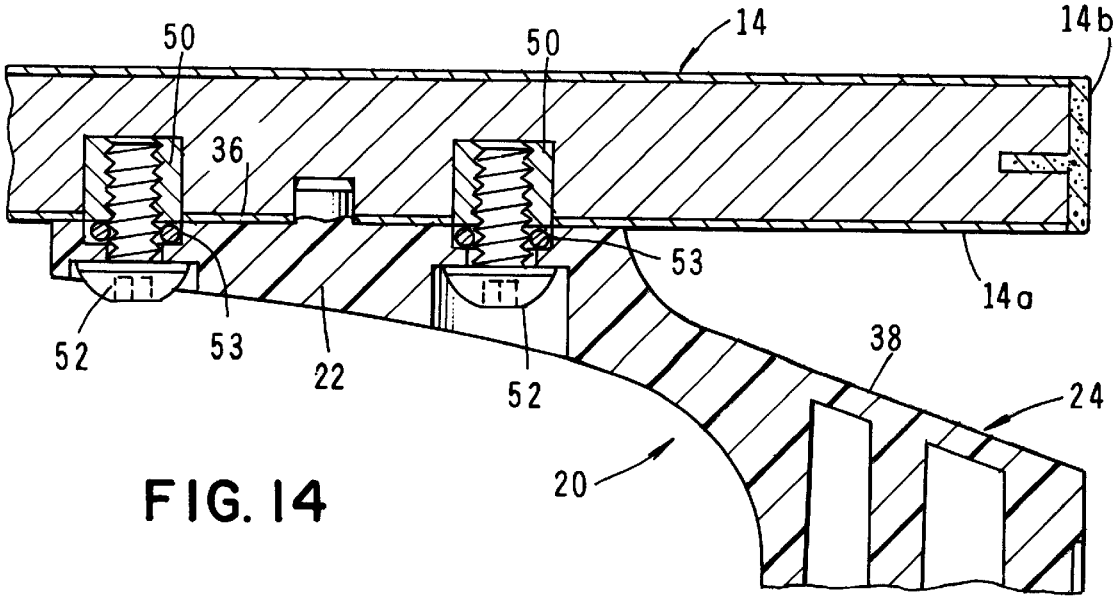
FIG. 14 is a cross-sectional view taken along lines 14—14 of FIG. 13.

Whether the connector means is used to support a single tabletop or a pair of closely adjacent tabletops such as T-1 and T-2 (FIGS. 19 and 20), the connector means can be quickly and easily connected to with the lower surface 14*a* of the tabletop using internally threaded anchor members 50 which threadably receive externally threaded bolts 52 which extend through aperture 53 formed in segment 22. Anchor members 50 are preferably formed of metal or hard plastic and are embedded into the lower surface 14*a* of the tabletop in the manner best seen in FIGS. 14 and 15.

To enable quick interconnection of the bolts 52 which the anchor members 50 a hand operated tool or "L" shaped wrench 54 is provided. When not in use, wrench 54 is conveniently stowed within an elongated cavity 56 formed in upper surface 36 of segment 22 (FIG. 5). With this novel construction, once the connector means has been securely interconnected with the tabletop, wrench 54 can be slipped into cavity 56 where it will be safely stowed in a secure and unobtrusive manner (See also FIG. 13).

Forming another important aspect of the apparatus of the present invention is the novel wire management means for managing electrical conduits which may be used to provide power to electrically operated devices such as overhead projectors, video players, computers, microphones, speakers and the like (see phantom lines of FIG. 1) which are commonly used during the conduct of seminars and similar events.

Figure 1:
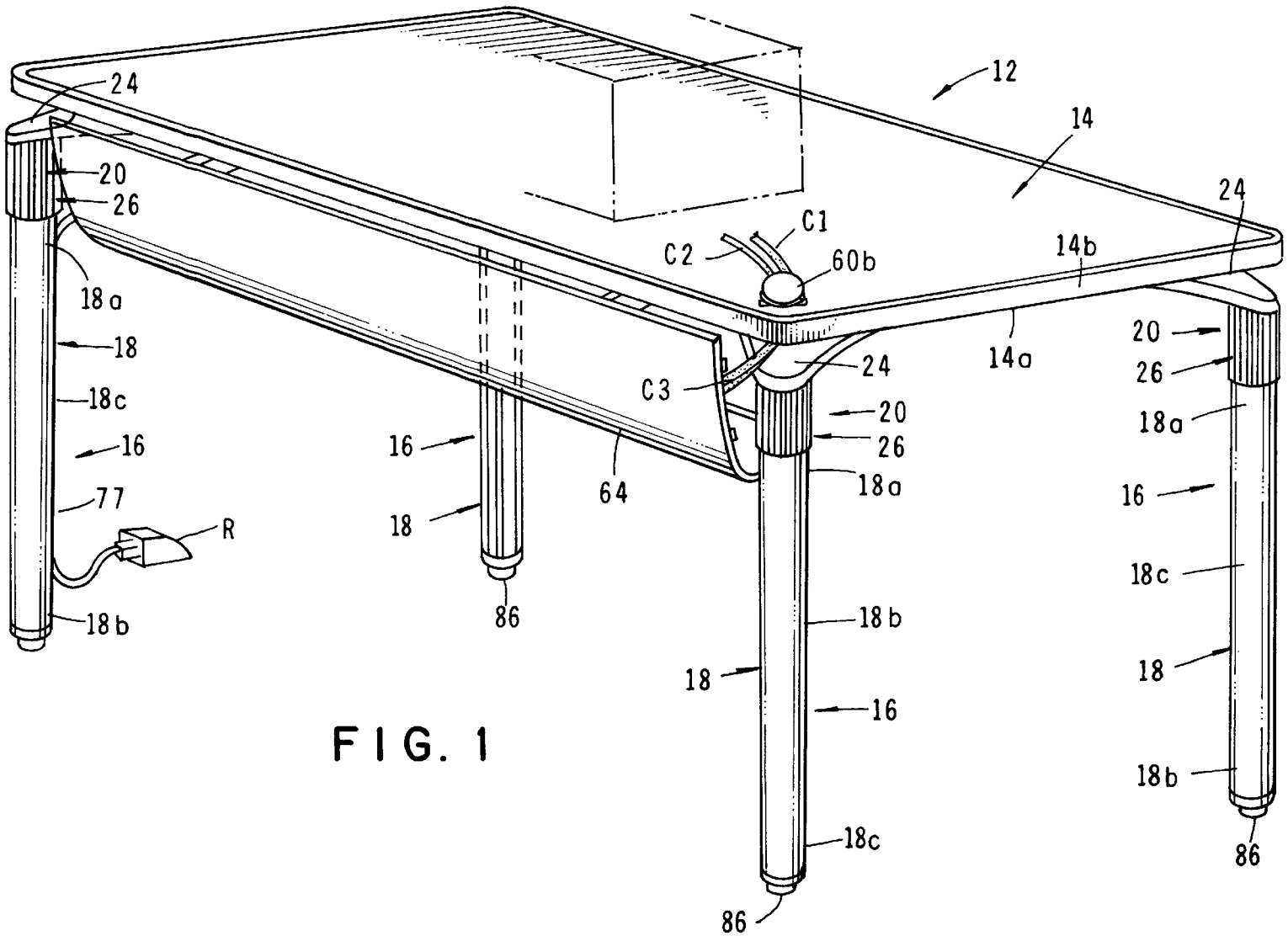
FIG. 1 is a generally perspective view of one form of the table of the invention.

As best seen by referring to FIGS. 1, 3, and 10 the novel wire management system of the present invention comprises a receptacle 60 mounted within a cavity 60*a* which is closed by a closure cap 60*b* and an elongated wire manager or apron 64 which extends along one of the marginal portions of the tabletop (see also FIG. 2A).

Figures 8, 9:
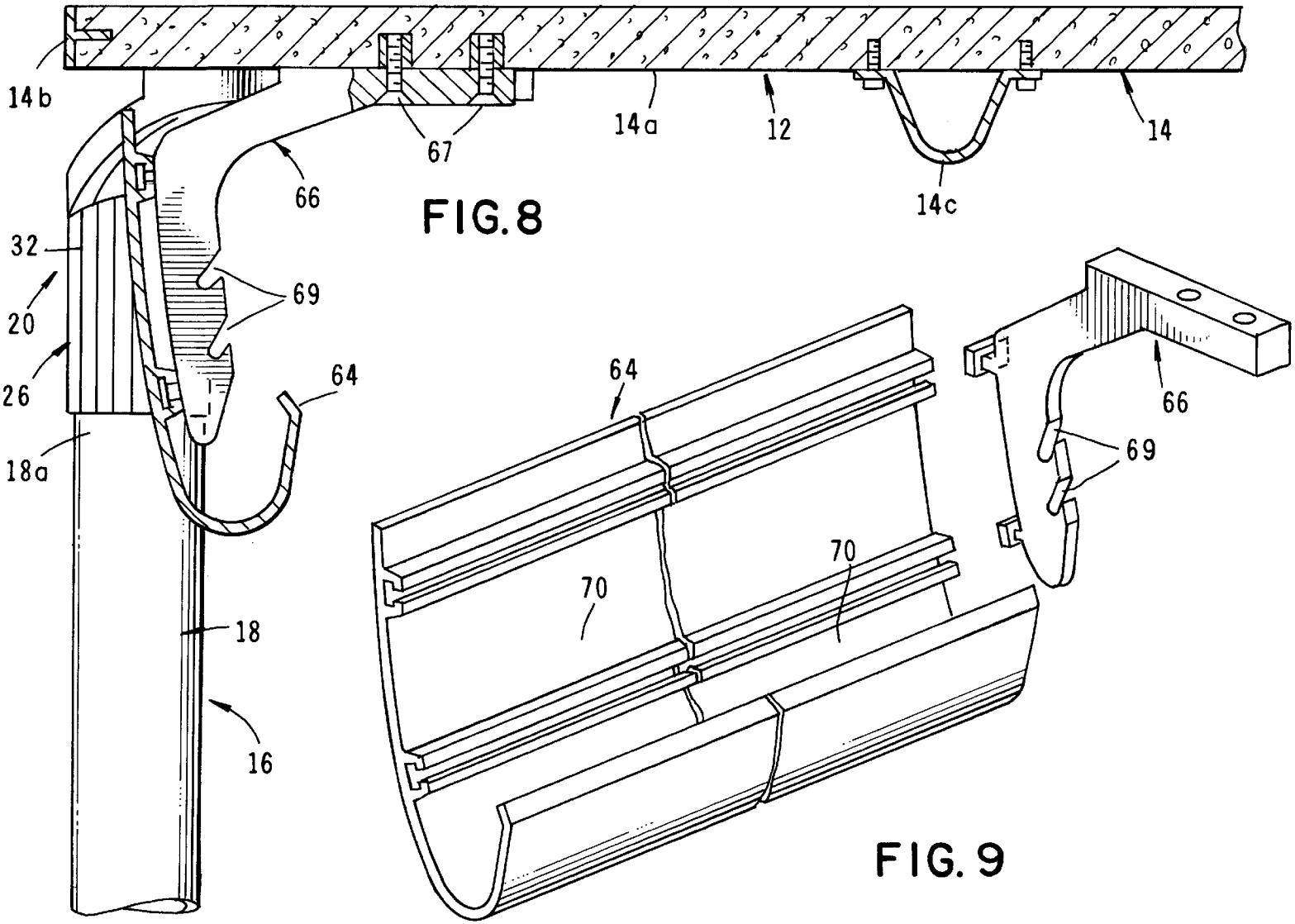
FIG. 8 is a cross-sectional view taken along lines 8—8 of FIG. 7.
FIG. 9 is a greatly enlarged, fragmentary, generally perspective view of portions of the subassembly of table construction.

A pair of brackets 66, which are connected to the under surface 14*a* of tabletop 14 by appropriate connectors 67, depend from and support apron 64 in the manner shown in FIGS. 1, 2B, and 3. As best seen in FIGS. 8 and 9, a pair of wire supporting notches, 69, are formed in brackets 66 in substantial alignment with a pair of longitudinally extending wire support channels 70 provided on the inner surface of apron 64. As shown in FIGS. 3 and 10, with the construction just described and with cover 60*a* opened, conduits C1 and C2 can be run from a device resting on the tabletop along the surface of the tabletop and then using an appropriate connector, can be interconnected with receptacle 60. Similarly, one or more conduits C3 can be extended downwardly from receptacle 60 into longitudinally extending apron 64 and then into specially configured conduit receiving recesses 77 formed in each of the legs 18. With one of the legs positioned close to and electrical receptacle such as floor receptacle R, conduit C1 and C2 can be interconnected with receptacle without creating any type of tripping hazard as is commonly found with electrical connectors which must run across the floor and then up to the top of a conference table in order to operate electrically powered equipment.

Turning to FIG. 112 it is to be noted that in one form of the invention, the bottom portion 18*b* of each of the legs of the leg assemblies of the invention is provided with a connector sleeve 80 which is telescopically received within the bottom portion of the leg in the manner shown in FIG. 11. Sleeve 80 is provided with an internally threaded bore 82 which is adapted to threadably receive the shank portion 84 of a conventional type caster 86.

As indicated in FIGS. 2A and 2B, an alternate type of caster can be affixed to sleeve 80, this caster here takes the form of a rolling ball type caster 86*a*, having a threaded shank portion 90 which is receivable within threaded bore 82.

Still an alternate form of caster arrangement of the invention is shown in FIGS. 17 and 18, in this embodiment of the invention the caster arrangement comprises an elongated sleeve 92 which is telescopically received within the lower portion 18*b* of leg 18. Sleeve 92 carries a conventional caster 86 which is threadably adjustable relative to sleeve 92. Sleeve 92 can be telescopically positioned at various locations within the lower leg portion 18*b* and can be retained at a selected position using a locking screw 94 of the character shown in FIG. 18. As shown in FIG. 18, locking screw 94 extends through an opening 95 provided in the lower portion of leg 16 and then into a selected aperture 97 provided along the length of sleeve 92. With this construction the height of the tabletop above floor level can really be adjusted to meet special requirements in use of the table assembly.

Referring to FIG. 15, another form of leg assembly of the invention is there shown. Here the leg 98 is of a solid wooden construction which is removably connected to a slightly different form of connector member 20*a* by a threaded connector 99. A conventional castor 86 is connected to leg 98 by means of the previously identified threaded shank portion 84 which is threadably receivable within an internally threaded sleeve 100. Alternatively, a roller type castor assembly 86 can be attached to leg 98 in the manner shown in FIG. 16.

Figure 21:
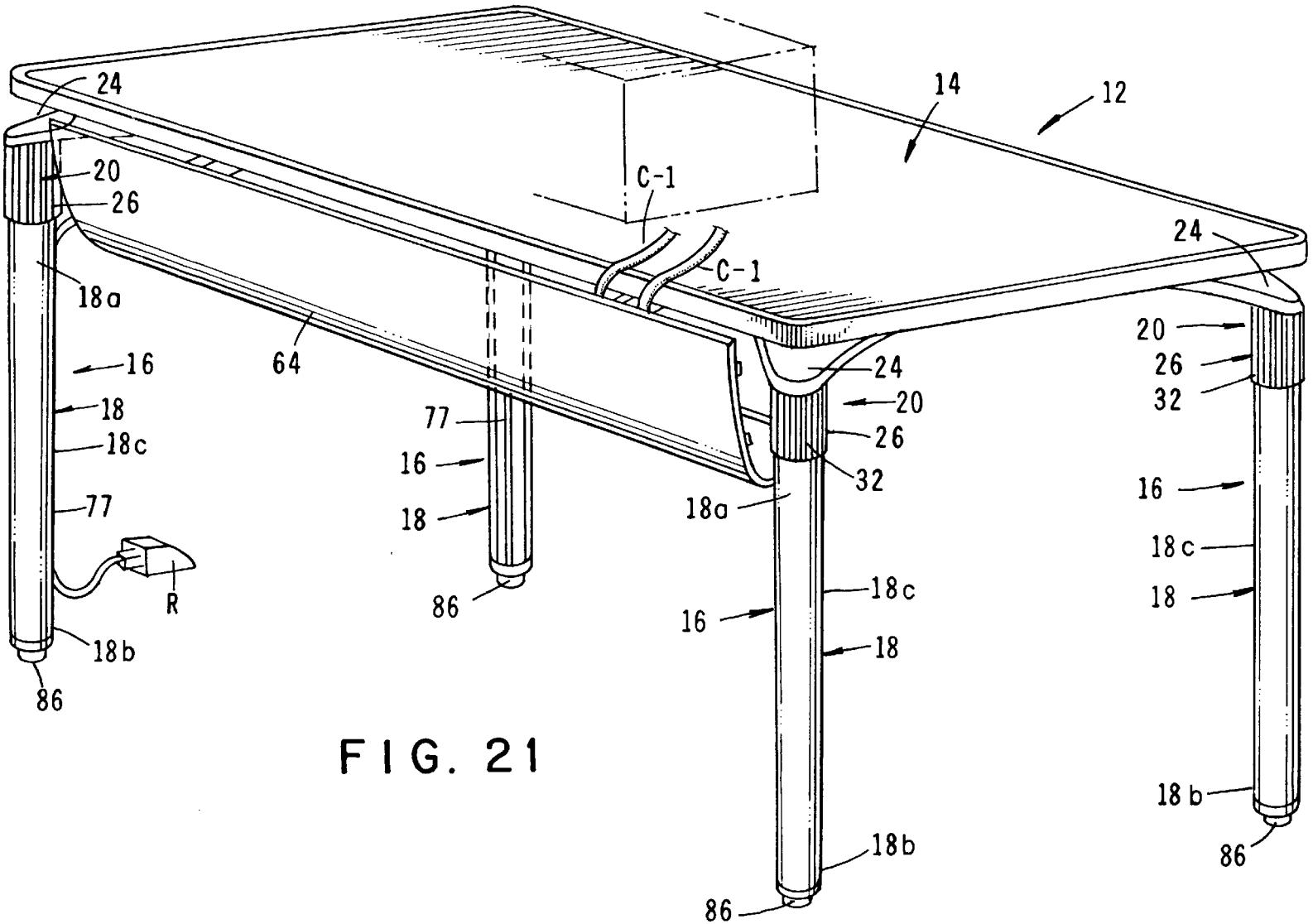
FIG. 21 is a generally perspective view of an alternate form of the table construction of the invention showing a different type of wire management system.
Figure 22:
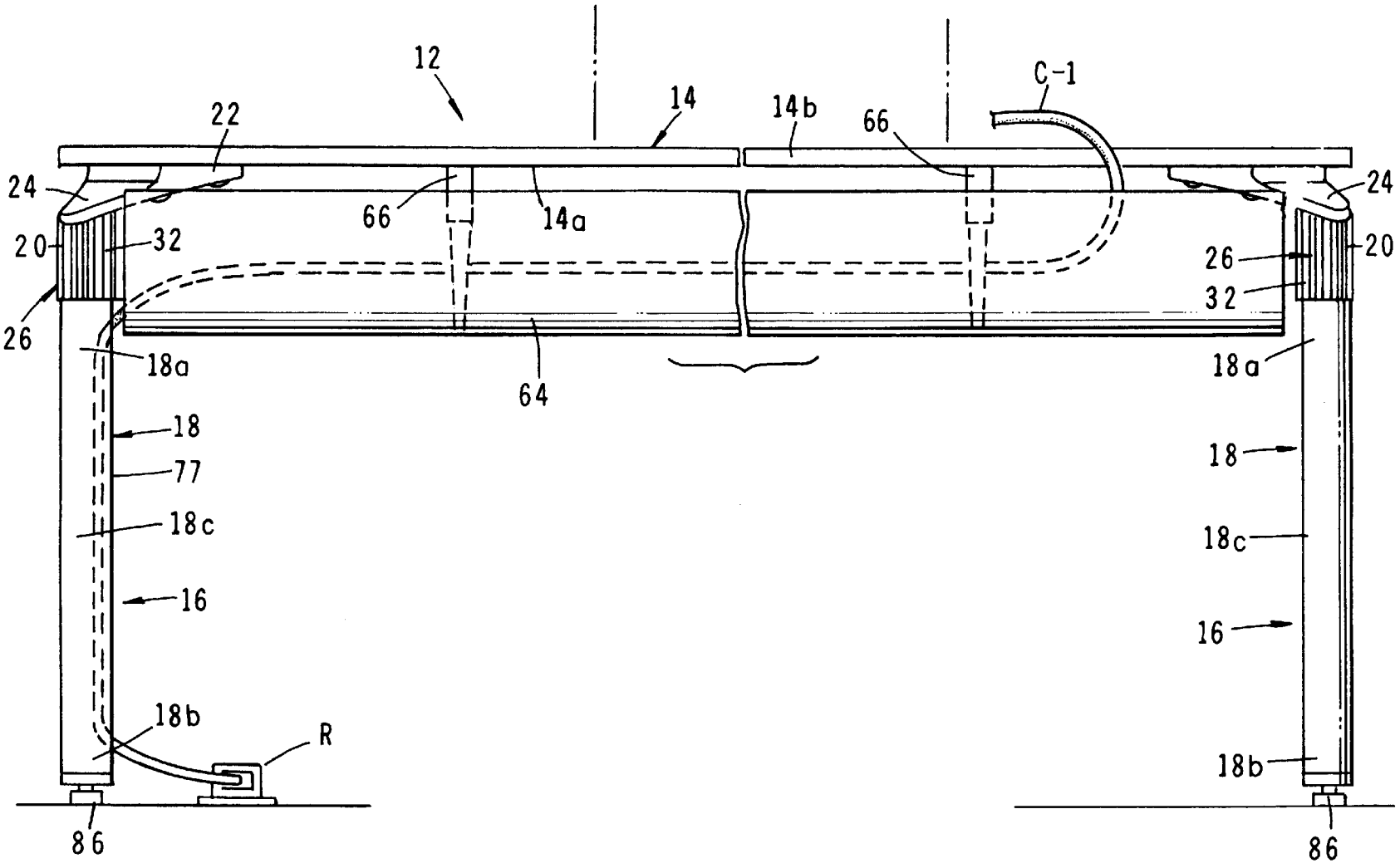
FIG. 22 is a side-elevational view of the table construction shown in FIG. 21.

Turning finally to FIGS. 21 and 22, yet another form of the table construction of the invention is there shown. This construction is quite similar to that shown in FIGS. 1 and 3 and like numerals are used to identify like components. In this last form of the invention, cables C-1 and C-2, rather than being connected to an intermediate receptacle 60, are entrained over the edge of the table and directly into wire manager 64. In the manner shown in FIG. 22, the cables then extend along wire manager 64, into recess 77 and one of the legs and then outwardly of the leg for direct interconnection with receptacle "R".

Figure 19:
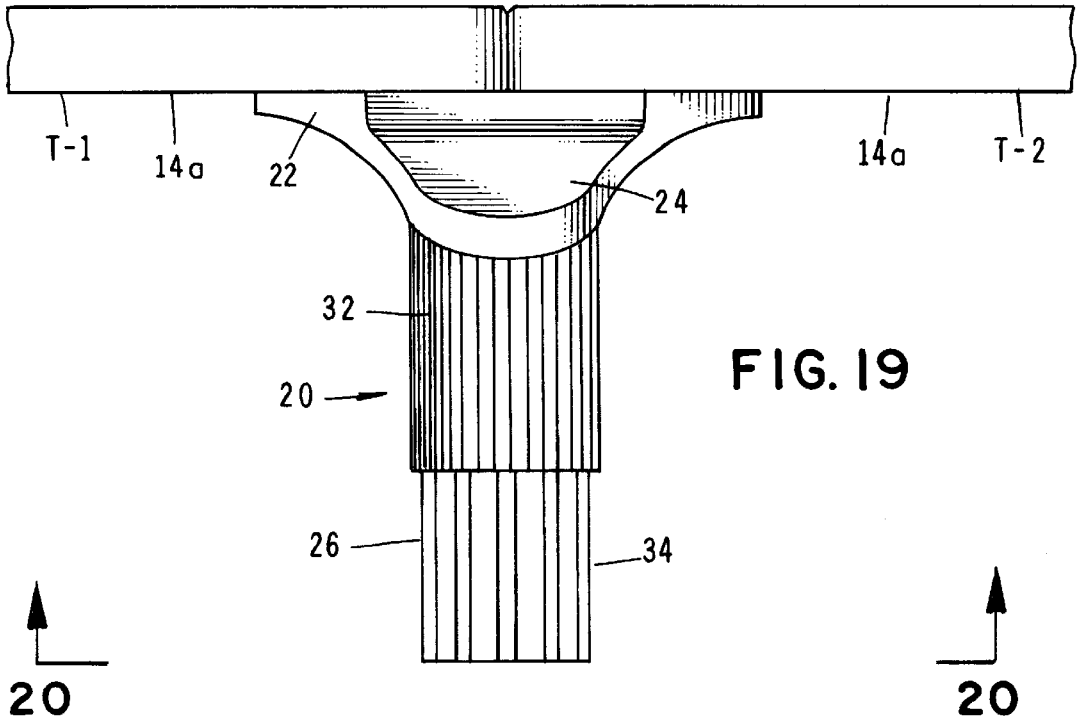
FIG. 19 is a side-elevational view of one of the leg connector assemblies of the invention interconneted with two adjacently disposed tabletops.
Figure 20:
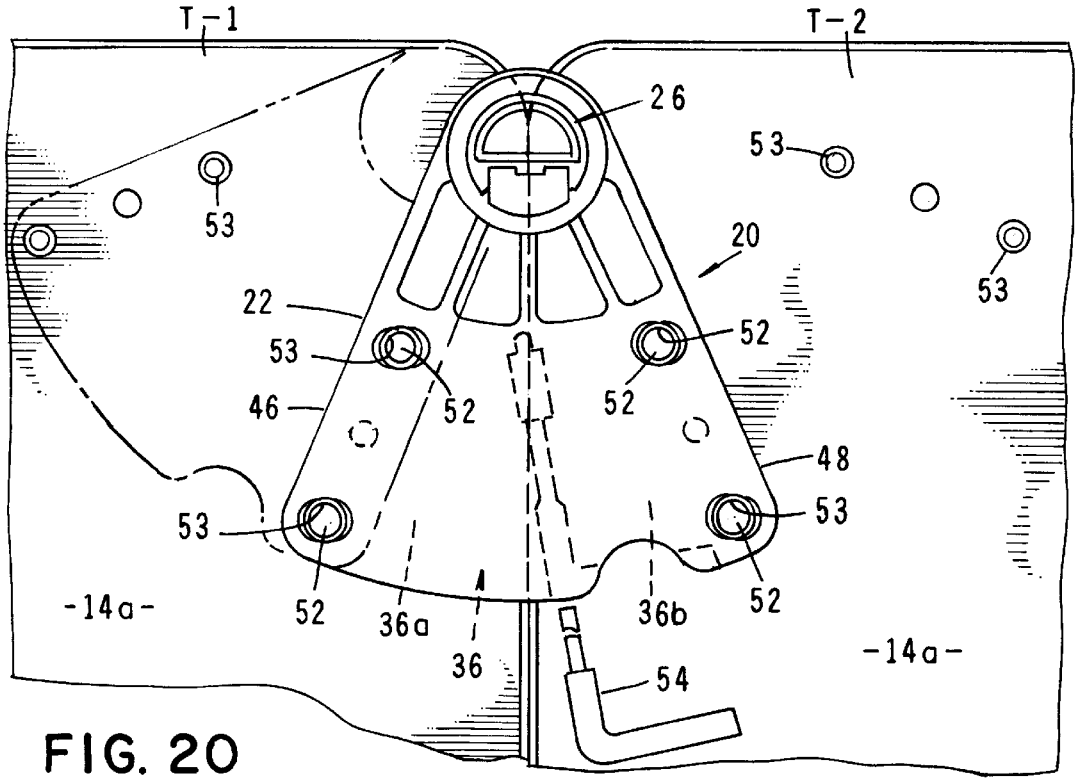
FIG. 20 is a view taken along lines 20—20 of FIG. 19.

Another important feature of the table construction of the invention is shown in FIGS. 19 and 20. As illustrated in the these figures, the novel sculptured connector 20 of the invention is used to support adjacent tabletops T-1 and T-2. More particularly, as best seen in FIG. 20, a first portion 36*a* of surface 36 is connected to tabletop T-1 while a second portion 36*b* is connected to table top T-2. With this novel construction, a single leg can be used to support one corner of each of the two adjacent tabletops T-1 and T-2. It is to be understood that, while tabletops T-1 and T-2 are shown in the drawings as being generally rectangular, tabletops of curved and angular construction can also be supported by the fan-shaped connector surface 36.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A leg assembly for use with at least one table having a table top, including an upper surface, a lower surface, and a marginal portion circumscribing said lower surface, said leg assembly comprising:

(a) a leg having an upper portion, a lower portion and an intermediate portion, said upper portion having a socket formed therein;

(b) a connector for connecting said leg to at least one table, said connector comprising:

(i) a first table engaging segment provided with a plurality of bolt receiving apertures and having a table engaging surface disposed within a first plane, said first table engaging segment having a first end having a first width, a second end having a second width less than said first width and angularly, inwardly extending side walls interconnecting said first and second ends, said first table engaging segment further including a tool receiving cavity extending from said first end to a location proximate said second end;

(ii) A second, generally fan shaped extension segment connected to said second end of said table engaging segment and extending angularly downward from said first table engaging segment, said second extension segment having a surface disposed in a second plane, said second plane extending at an acute angle with respect to said first plane; and (iii) A leg assembly engaging segment connected to and extending from said second extension segment, said leg assembly extending segment having a generally cylindrical portion and a connecting portion received within said socket of said upper portion of said leg.

2. A leg assembly as defined in claim 1 in which said first table engaging segment is provided with a plurality of bolt receiving apertures.

3. A leg assembly as defined in claim 2 in which said leg assembly further includes a bolt tightening tool at least partially disposed within said tool receiving cavity.

* * * * *